United States Patent [19]

Piltz

[11] Patent Number: 4,913,306

[45] Date of Patent: Apr. 3, 1990

[54] OPENABLE END CLOSURE FOR A PACKAGING CONTAINER

[75] Inventor: Lars-Erik Piltz, Dalby, Sweden

[73] Assignee: AB Akerlund & Rausing, Sweden

[21] Appl. No.: 310,609

[22] Filed: Feb. 10, 1989

[30] Foreign Application Priority Data

Feb. 16, 1988 [SE] Sweden ..... 88005178

[51] Int. Cl.[4] ..... B65D 41/50

[52] U.S. Cl. ..... 220/270

[58] Field of Search ..... 220/257, 270, 273; 215/251; 229/123.2; 206/628

[56] References Cited

U.S. PATENT DOCUMENTS

| | | | |
|---|---|---|---|
| 3,338,199 | 8/1967 | Taylor | 220/270 X |
| 3,650,387 | 3/1972 | Hornsby et al. | 220/273 X |
| 4,548,333 | 10/1985 | Kobayashi et al. | 220/270 X |
| 4,830,214 | 5/1989 | Curliss et al. | 220/270 |

*Primary Examiner*—Donald F. Norton

*Attorney, Agent, or Firm*—Lerner, David, Littenberg, Krumholz & Mentlik

[57] ABSTRACT

An end closure for a packaging container, where the end closure has a central panel and a circumferential rim for being attached to a wall of a packaging container for placing the panel countersunk in the container.

A tearing denotation is arranged in the panel and merges into a further tearing denotation extending the whole way around the panel close to the rim.

A low ledge is arranged at the side of the panel opposite to the rim for maintaining an easily flexible material covering the underside of the end closure and at least part of the rim outer side thereof at a non-welding distance at both sides of the tearing denotation, i.e. at such a distance that the temperature and pressure is insufficient for heat sealing or welding of thermoplastics material on the flexible material and/or the panel.

9 Claims, 1 Drawing Sheet

OPENABLE END CLOSURE FOR A PACKAGING CONTAINER

BACKGROUND OF THE INVENTION

The present invention relates to an end closure or a cover for a packaging container, where the container for instance may be of the can type or basically of any type as long as it has or may be arranged with a feasible connection piece, for instance a pipe end piece, for the end closure.

More precisely there is disclosed an end closure which in a closed condition comprises at least two different material layers arranged for being penetrated in two steps, such that first the outer layer is penetrated by a so called easy opening device, whereafter the inner layer is removed in any suitable manner, for instance by a knife or a pair of scissors.

According to the present invention the material of the end closure is a combination of plastics and metal, a combination of plastics and metallized plastics or a combination of two different plastics material, at least one of which is of an oxygene and water vapor high barrier type.

BACKGROUND OF THE INVENTION

Frequently, there is a need for providing a so called "full panel opening" of a packaging container, i.e. a maximum of opening area is aimed at. In order to offer a simple and splash free handling, the pouring edge that will be formed should be absolutely smooth.

In order to get such a pouring edge, a portion of the tearing denotation in the outer layer generally is placed as close as possible to a circumferential rim around the panel of the end closure. When the outer layer of the end closure comprises a plastics material, generally an injection moldable material, for instance polypropylene, and when the inner layer is a metal foil, for instance an aluminum foil, coated by plastics at both sides thereof or a weldable high barrier plastics film, for the further handling of the end closure there is a need for welding a circular blank or a piece of material of said metal or plastic material to the end closure, such that the blank or the flexible material will be attached merely to the outside of the rim.

When the combination of materials so allows, the welding may be a high frequency welding or an induction welding operation and in such cases it is preferred to use an external support and an internal welding jaw for the welding operation, especially when the rim is conical and thereby, at an axial input movement in the support, provides a sealing pressure at the sealing area and, at the same time, the input and output operations from the support will be simple axial operations.

Preferably there are used conically shaped welding jaws which also facilitate the input and output.

Heat will be provided where the electric field and/or the magnetic field dissipates energy, i.e. where the metal and/or the electric conducting material exists, and it is essential to see to it that such heat generation does not imply melting and thereby certain, if not perfect welding against the tearing denotation that exists close to the rim.

OBJECTS OF THE INVENTION

The object of the present invention is to offer a solution to said problem. Additionally, the invention provides a solution which is not limited to a certain opening method or a certain opening arrangement for the outer material layer. By a simple, in situ effectable modifying operation the end closure is for instance easily re-shapable into an end piece suitable for being opened in one single step, i.e. an end piece where the opening arrangement allows penetration of the two material layers in one and the same step.

SUMMARY OF THE INVENTION

Thus, the invention provides an openable end closure for a packaging container, comprising a centrally disposed cover panel and a circumferential rim arranged for attachment to a wall of a packaging container for placing the panel counter sunk in the container part and a tearing denotation arranged in the panel and having a portion thereof extending the whole way circumferentially around the panel close to the rim.

The end closure is characterized by a low ledge being arranged at the side of the panel opposite to the rim for maintaining a flexible piece of material covering the lower side of the end closure and at least part of the outer rim surface at a non welding distance from at least the portion of the tearing denotation located close to the rim.

Preferably, the ledge is formed as an extended base portion of the rim.

In one embodiment the extended base portion defines an outer surface which is perpendicular to the panel.

Preferably, the base portion merges into the rim under said perpendicular angle, whereafter the rim has a shape diverging out from the cover panel.

Preferably, the ledge extends around the entire circumference and defines a circular cylindric base portion merging into a truncated conical rim. In order to optimize the welding procedure the shape of the rim preferably is matched to an external, conically truncated support, against which a welding tool placed at the flange or rim acts, without, due to the positioning of the ledge, effecting welding over of the tearing denotation located close to the rim or flange by a piece of flexible material placed in the support.

In one preferred embodiment the flexible piece of material is a metal foil or corresponding type of circular blank attachable to the rim outside by high frequency welding or induction welding.

DESCRIPTION OF PREFERRED EMBODIMENTS

Figure 1:
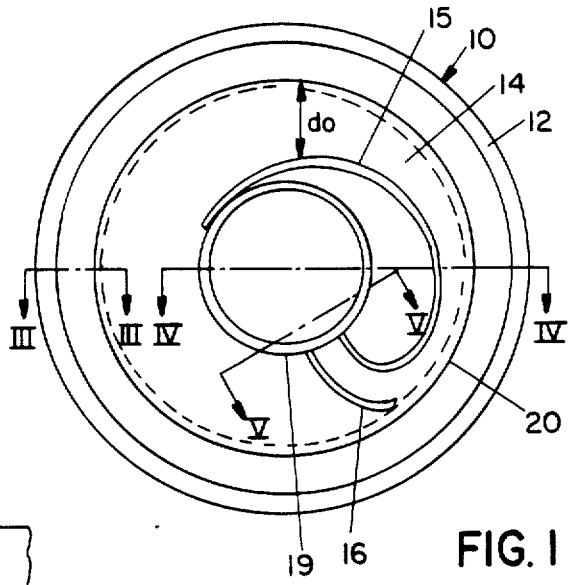
FIG. 1 in a view from above shows an easy openable end piece or cover according to the invention.
Figure 3:
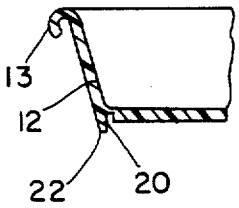
FIG. 3 is a partial cut along the arrows III—III in FIG. 1.

The reference numeral 10 in FIG. 1 denotes the outer part of an end closure from above, and in this particular case the outer part has an arrangement for easy opening formed therein. The part 10 is injection moulded of plastics, for instance polypropylene, and the entire part or element has been manufactured by using one single centrally placed ingot.

Figure 2:
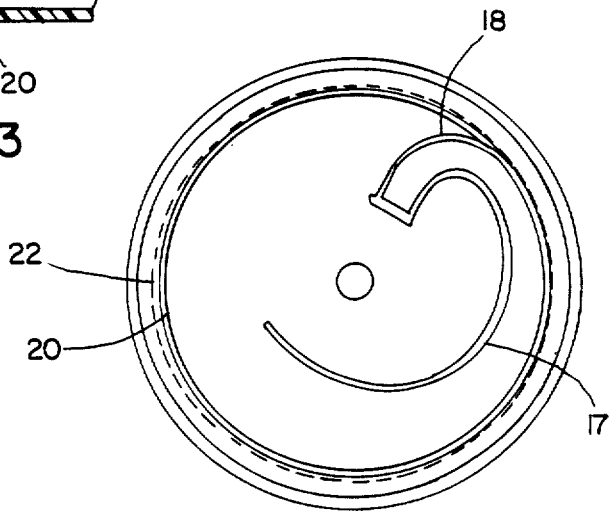
FIG. 2 shows the end closure seen from below.

As well recognized by those having ordinary skill in the art of injection molding, by the term "Ingot", it is understood that an aperture in the bottom of a mold through which material is injected is contemplated. The area of injection has been represented in FIG. 2 by a centrally placed circle. In this regard, see also, for example, FIG. 9 of U.S. Pat. No. 4,830,214. The part 10 comprises a circumferential rim 12 and an upper end edge 13 forming a groove. Said rim merges into a central panel 14. At the upper side of the panel 14 there are small beads 15 and 16, each one reflecting the existance of tearing denotations 17, 18 formed at the lower side of the panel.

Figure 4:
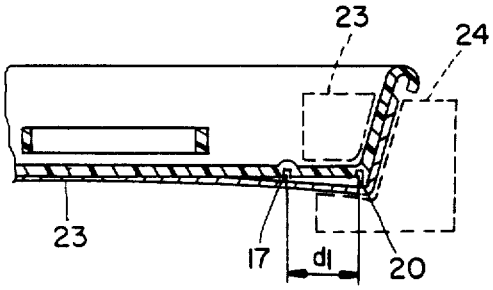
FIG. 4 is a further partial cut along the arrows IV—IV in FIG. 1.

The beads 15, 16 which give a well defined tearing extension and additionally facilitate the flow of material when injection molding, merge into a centrally placed pulling ring 19 of a sufficient diameter for facilitating the insertion of a finger. The ring 19 is located at a certain small distance from the upper side of the panel, as appears from FIG. 4.

Figure 5:
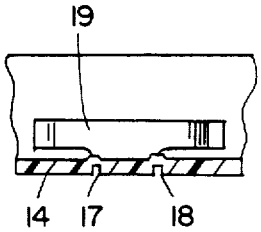
FIG. 5 is a further partial cut along the arrows V—V in FIG. 1.

FIG. 5 shows the transition region between the ring 19 and the panel 14 and the two tearing denotations 17 and 18. The tearing denotation 18 merges into a tearing denotation 20 extending circumferentially around and close inside the rim 12, and has such a position relative the inside of the conical rim 12, that there is obtained a smooth pouring edge out from the container, against the inner wall which the outside of the rim 12 is to be attached.

At the under side of the rim 12, integral therewith there is formed a low ledge 22 extending circumferentially around the panel, and in the present case the ledge 22 forms an angle with the panel 14 different from the one formed by the rim. The outer side of the ledge forms in the present case an axially short circular cylindric surface, which according to the invention has a specific, important function for the accomplishment of the so called two-step cover mentioned at the introduction, i.e. a cover where the outer part first is penetrated by means of an opening device arranged at such outer part, whereafter the inner part is penetrated.

According to the invention it has been discovered that the condition for applying an inner membrane or blank of a flexible, weldable material, for instance a plastics coated aluminum foil or alternatively a high barrier plastics material, requires a rational and functional welding method, which is such that it is useful basically both at one step and two step covers, but where the later cover type does not allow welding at both sides of the said tearing denotation placed close to the rim.

According to the present invention it has been found that when said flexible piece of material or blank 23 is placed into a welding tool comprising an external support 24 and an inner welding jaw 23, and the blank 23 thereby extends a bit up onto the rim outside 12, basically there can be used a welding technique useful for both types of covers if the condition is met that there exists a ledge according to the present invention.

It is necessary to dimension the height of the circumferential ledge 22 such that there is no welding pressure and no welding temperature in the region defined by the distance $d_1$. In the specific embodiment the tearing denotation 17 has a spiral type of extension, meaning that the distance $d_1$ is increasing towards the end point of the tearing denotation 17. This distance $d_1$ is such that there is no risk for adherence or welding in the region of the tearing extension. The form is to dimension the ledge such that it withstands the minimum distance $d_1$ between the tearing denotations. In practice the distance $d_1$ is so large that there will be no risk for welding in the region of the tearing denotation 17, meaning that the essential point is to guarantee that the outer tearing denotation 20 is the one for which non-welding security does prevail.

We claim:

1. An openable end closure produced by injection moulded thermoplastic material comprising: a circumferential rim defining an outer periphery of said end closure, said rim being adapted for welding to a wall of a packaging container; a centrally arranged cover panel integrally attached thereto, said rim and said centrally arranged cover panel being joined in the proximity of at least a first circumferential tearing denotation spaced inwardly from said rim, said first circumferential tearing denotation defining an outer edge of a tearing extension; and a circumferential ledge disposed on a lower side of said end closure, said circumferential ledge being disposed between said first circumferential tearing denotation and said rim, and said circumferential ledge being of a size and shape adapted to maintain a flexible piece of material covering said lower side of said end closure at least a predetermined distance from said tearing extension.

2. An end closure as in claim 1, wherein the ledge forms an extended base portion of the rim.

3. An end closure as in claim 2, wherein the extended base portion defines an outer surface perpendicular to the panel.

4. An end closure as in claim 3, wherein the rim has a shape diverging outwardly from the closure panel.

5. An end closure as in claim 4, wherein the ledge is circumferential and defines a circular cylindric base portion merging into a conically truncated rim.

6. The openable end closure of claim 1 further comprising a flexible piece of material covering said lower side of said end closure and adapted to be attached to said circumferential rim thereof by welding, whereby said ledge acts to prevent the attachment of a flexible piece of material to at least said lower side of said tearing extension during welding.

7. The openable end closure of claim 1 wherein said flexible piece of material is attached to said circumferential rim by high frequency welding.

8. The openable end closure of claim q wherein said flexible piece of material is attached to said circumferential rim by induction welding.

9. The openable end closure of claim 1 wherein said flexible piece of material is a metal foil.

* * * * *

UNITED STATES PATENT AND TRADEMARK OFFICE

CERTIFICATE OF CORRECTION

PATENT NO. : 4,913,306

DATED : April 3, 1990

INVENTOR(S) : Lars-Erik Piltz

It is certified that error appears in the above-identified patent and that said Letters Patent is hereby corrected as shown below:

Column 4, line 51, "1" should read --6--.
Column 4, line 54, "q" should read --6--.
Column 4, line 57, "1" should read --6--.

Signed and Sealed this

Thirtieth Day of July, 1991

*Attest:*

HARRY F. MANBECK, JR.

*Attesting Officer*

*Commissioner of Patents and Trademarks*